US005393037A

United States Patent [19]

Ehle et al.

[11] Patent Number: 5,393,037

[45] Date of Patent: Feb. 28, 1995

[54] SMELTING UNIT WITH FURNACE ROCKING CRADLE

[75] Inventors: Joachim Ehle, Lautenbach; Gerhard Fuchs, Kehl-Bodersweier, both of Germany

[73] Assignee: Fuchs Technology AG, Zug, Switzerland

[21] Appl. No.: 90,015

[22] PCT Filed: Nov. 17, 1992

[86] PCT No.: PCT/EP92/02644

§ 371 Date: Aug. 23, 1993

§ 102(e) Date: Aug. 23, 1993

[87] PCT Pub. No.: WO93/10413

PCT Pub. Date: May 27, 1993

[30] Foreign Application Priority Data

Nov. 19, 1991 [DE] Germany ..... 4138120

[51] Int. Cl.[6] ..... F27B 3/16

[52] U.S. Cl. ..... 266/144; 266/158; 266/159; 266/144; 373/9

[58] Field of Search ..... 266/144, 145, 158, 159, 266/240, 44; 373/8, 9, 94, 98, 99

[56] References Cited

U.S. PATENT DOCUMENTS

| | | | |
|---|---|---|---|
| 3,684,261 | 8/1972 | Wynne | 266/240 |
| 3,999,001 | 12/1976 | Overmyer et al. | 373/9 |
| 4,476,564 | 10/1984 | Buhler | 373/9 |
| 4,866,731 | 9/1989 | Zajicek | 373/73 |
| 5,153,894 | 10/1992 | Ehle et al. | 373/94 |

FOREIGN PATENT DOCUMENTS

| | | |
|---|---|---|
| 1219181 | 6/1966 | Austria . |
| 0077319 | 4/1983 | European Pat. Off. . |
| 0291497 | 11/1988 | European Pat. Off. . |
| 0386586 | 9/1990 | European Pat. Off. . |
| 1433424 | 2/1969 | Germany . |
| 2828634 | 9/1985 | Germany . |
| 54-99707 | 6/1979 | Japan . |
| 3-13793 | 1/1991 | Japan . |

*Primary Examiner*—Scott Kastler

[57] ABSTRACT

A smelting unit having a furnace vessel (11) which is mounted on a furnace rocking cradle (13) and which can be closed by a cover (12), and bar electrodes (28) which can be lowered into the furnace vessel (11) and which can be raised and lowered by means of electrode lift devices (30), in which the electrode lift devices (30) are carried by a portal assembly (31). In a lowered position the portal assembly (31) lies on a support holder (33) of the vessel substructure (14) or the furnace rocking cradle (13) respectively and in that position can be tilted with the furnace vessel (11). It can be released from the furnace vessel (11) and pivoted to the side by a lift post (43) of a stationary lifting/pivoting mechanism (40). When the unit has two vessels which are arranged side-by-side, the bar electrodes can be associated alternately with one vessel or the other by means of the lifting/pivoting mechanism (40).

13 Claims, 3 Drawing Sheets

SMELTING UNIT WITH FURNACE ROCKING CRADLE

BACKGROUND OF THE INVENTION

1. Field of the Invention

The invention relates to a smelting unit as set forth below.

Smelting units of the kind set forth in the classifying portion are generally operated as an arc furnace and for that purpose mostly have a plurality of bar electrodes which can be introduced through suitable openings in the vessel cover into the furnace vessel in order there to melt charge material in the furnace vessel, with the formation of an arc therein. It is necessary for the furnace to be tiled both for the operation of removing slag from the molten bath during the melting operation and also for tapping off the furnace vessel after the melting operation has been concluded.

The electrodes which are introduced into the furnace vessel through the electrode openings in the furnace vessel cover are to remain in the furnace vessel at least during the operation of removing slag. In that respect, it is necessary to ensure that the bar electrodes do not suffer from damage as a result of a relative movement between the vessel cover and the bar electrodes. In the case of furnace vessels which are arranged on a furnace rocking cradle for the purposes of producing the tilting movement, because of the large distance between the plane in which the bar electrodes pass through the vessel cover and the rolling plane on which the furnace rocking cradle performs its rolling movement, it is necessary for the bar electrodes to be entrained in the tilting movement of the furnace vessel.

2. Description of the Related Art

German laid-open application (DE-OS) No. 14 33 424 discloses a smelting unit having a furnace which can be tilted by means of a furnace rocking cradle and which is adapted to be heated by bar electrodes which are passed through the vessel cover of the furnace. The bar electrodes are connected to the electrode lift devices by way of support arms. The electrode lift devices are disposed on a cover support mechanism which is in the form of a pivot arm and which is connected to the vessel cover on the one hand and which on the other hand can be coupled to a lifting/pivoting mechanism for lifting and pivoting movement of the vessel cover relative to the furnace vessel. The pivot arm, the electrode lift devices and the bar electrodes which are connected to the electrode lift devices by way of the support arms, together with the vessel cover, form a cover unit. In operation of the arc furnace, the cover unit lies on the furnace vessel and is uncoupled from the lifting-/pivoting mechanism. The bar electrodes which are introduced into the furnace vessel through the vessel cover can thus follow the tilting movements of the furnace without the possibility of a tilting movement occurring between them and the furnace cover.

However that known smelting unit suffers from the disadvantage that, during tilting of the furnace, the entire cover unit consisting of the cover support mechanism, the pivot arm, the electrode lift devices, the electrode support arms and the bar electrodes as well as the vessel cover must be moved if the vessel cover remains on the furnace vessel during the slag removal operation or tapping operation. The movement of that considerable mass makes it necessary to provide for a stable structure for the tilting mechanism as well as a tilting drive which is of a correspondingly powerful nature.

SUMMARY OF THE INVENTION

The object of the present invention is to design a smelting unit of the general kind set forth in such a way as to permit reliable operation with a simplified structure and smaller moved masses when tilting the melting furnace.

A smelting unit according to the invention is characterised by the features of claim 1. Advantageous configurations of that unit are set forth in claims 2 to 10.

DETAILED DESCRIPTION OF THE DRAWINGS

Figure 1:
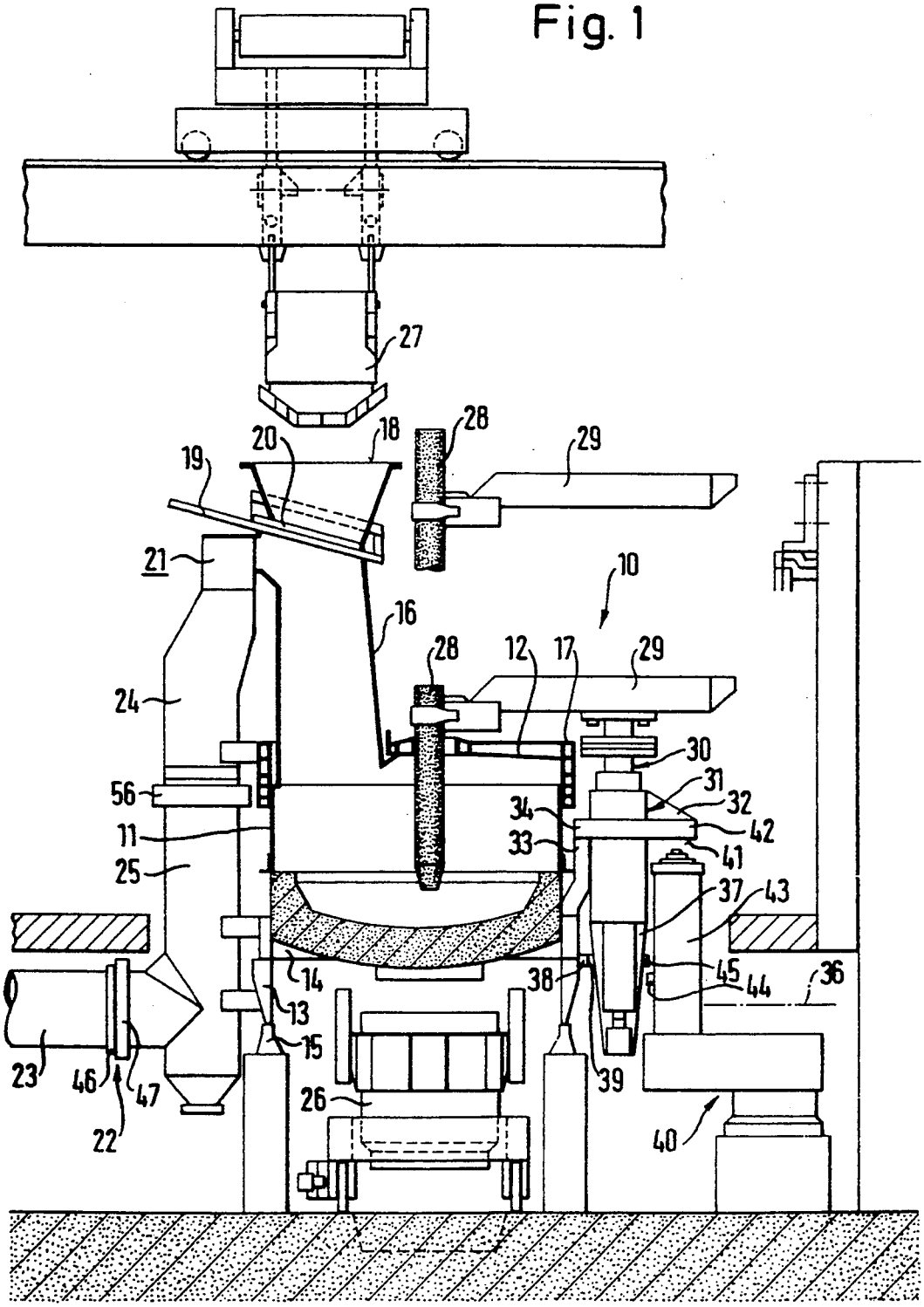
Figure 2:
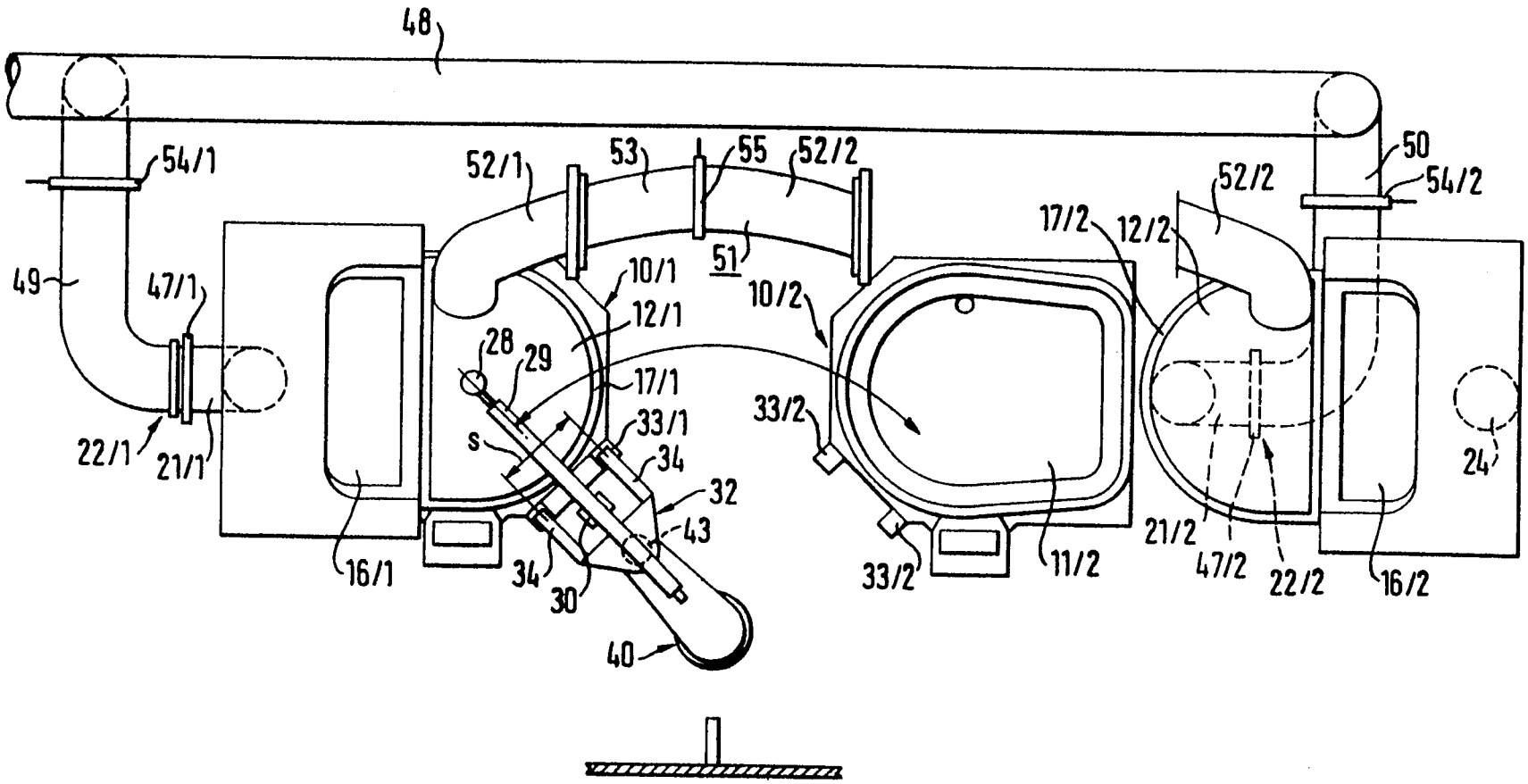
Figure 3C:
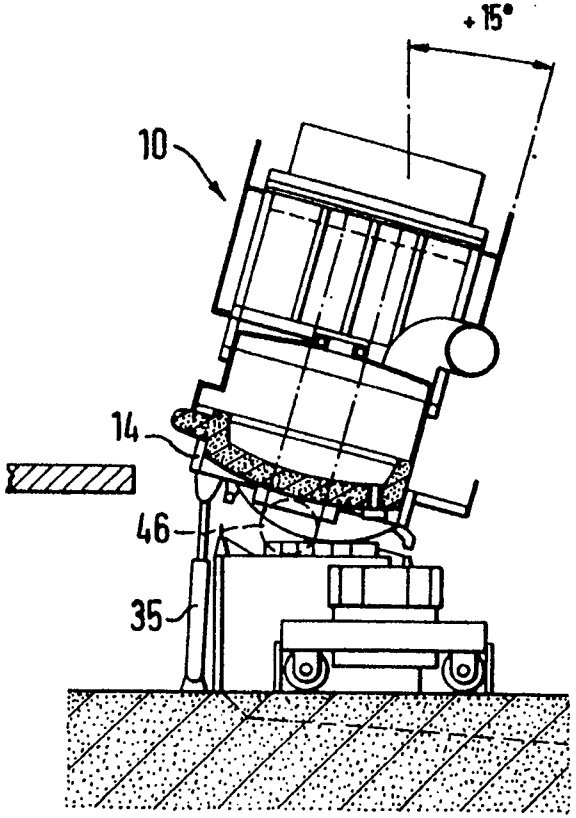
Figure 3B:
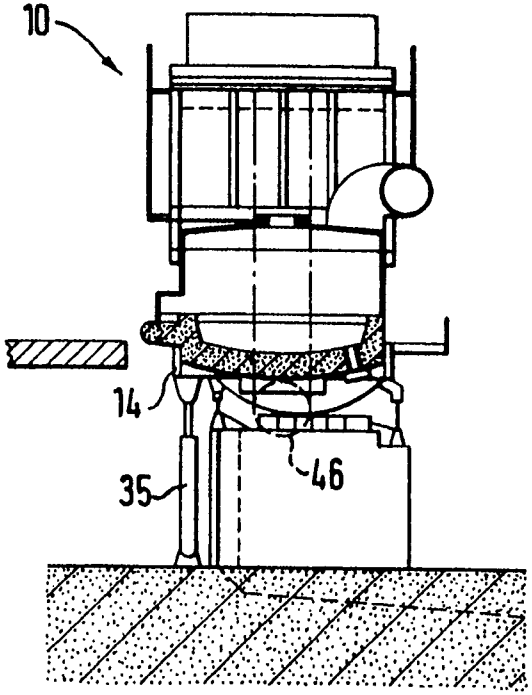
Figure 3A:
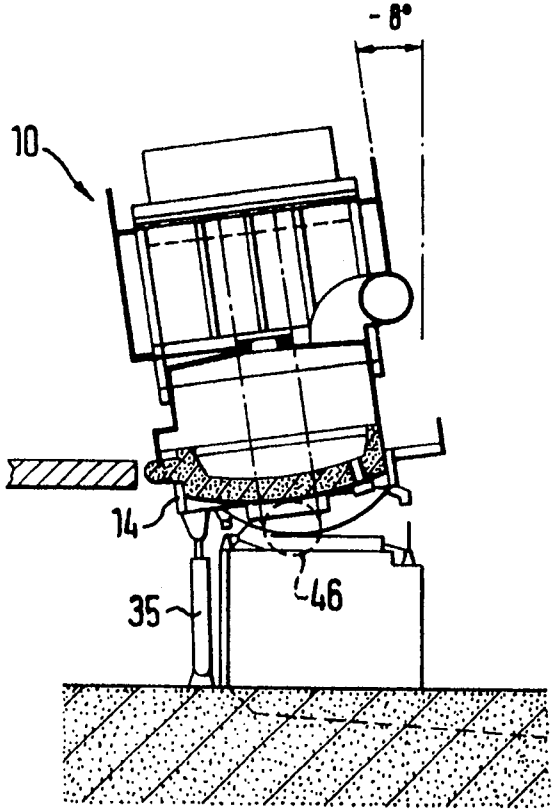

The invention is described in greater detail with reference to the following Figures which are each a diagrammatic view and in which:

FIG. 1 is a partly sectional view of a smelting unit according to this invention with a melting furnace, FIG. 2 is a plan view of a configuration, which has been modified in comparison with FIG. 1, of the smelting unit according to the invention, with two melting furnaces, and FIGS. 3A, 3B and 3C are views of a melting furnace in different positions of tilt.

DESCRIPTION OF THE PREFERRED EMBODIMENT

FIG. 1 shows a melting furnace 10 which has a furnace vessel 11 with a vessel cover 12 disposed thereon. The furnace vessel 11 is carried by a vessel substructure 14 which is disposed on a furnace rocking cradle 13. Upon a tilting movement of the furnace vessel 11 out of the plane of the drawing, the furnace rocking cradle 13 rolls on rolling tracks 15. For the purpose of producing the tilting movement, the assembly has control members 35 (see FIG. 3) which engage the vessel substructure 14 and which tilt the furnace vessel 11 forwardly or rearwardly depending on the respective requirements involved.

The vessel cover 12 is arranged together with a shaft 16 in a holding structure 17. At its upper end the shaft 16 is provided with a loading opening 18 which can be closed by means of a shaft cover 20 which is guided on rails 19. Disposed beneath the shaft cover 20 is a furnace gas discharge 21 which opens into a disposal conduit system 23 at a connecting region 22. The furnace gas discharge 21 is formed from an upper portion 24 and a lower portion 25 which are connected by way of holders to the holding structure 17 and the vessel substructure 14 respectively. Disposed beneath the furnace vessel 11 is a ladle 26 for receiving the molten material when the furnace vessel 11 is tapped off. Provided above the loading opening 18 of the shaft 16 is a charging material container 26 for loading charge material into the shaft 16.

Three bar electrodes 28 are provided for heating the melting furnace 10. Of the bar electrodes, FIG. 1 shows one electrode in the condition of being introduced into the furnace vessel and one electrode in the condition of being retracted from the furnace vessel. Each bar electrode is secured to an electrode support arm 29 which can be raised and lowered by means of an electrode lift device 30 associated therewith. The bar electrodes 28 can be introduced into the furnace vessel through electrode passages in the vessel cover 12.

The electrode lift devices 30 are carried by a portal assembly 31 which in its upper part has a support collar 32 (see FIG. 2) which is of a flange-like and U-shaped configuration and with which the portal assembly 31 rests on a support holder 33 on the vessel substructure 14. For that purpose, provided at the end of support limbs 34 of the U-shaped support collar 32 at the underside thereof are support surfaces which bear on corresponding support surfaces on the support holder 33. In that lower position of the portal assembly 31, namely the 'furnace vessel position', the portal assembly 31 is coupled to the vessel substructure 14 so that, upon a tilting movement of the furnace vessel 11 by means of the control members 35 shown in FIG. 3, the portal assembly 31 and therewith also the bar electrodes 28 which are introduced into the furnace vessel 11 can follow the tilting movement.

In order to carry the tilting moment which occurs when the furnace vessel 11 is tilted, about the tilting axis identified by reference numeral 36 in FIG. 1, the support surfaces of the support limbs 34 and the support surfaces of the support holder 33 are spaced from each other by a support spacing s (see FIG. 2). In addition, the support surfaces of the support holder 33 have holding bores into which engage holding pins which are disposed on the support surfaces of the support limbs 34.

In order to provide for a defined orientation of the bar electrodes 28 relative to the furnace vessel 11 in spite of the fact that the portal assembly 31 is only supported at one side on the support holder 33, the location at which the portal 31 is supported at one side on the support holder 33 is so selected that a support moment which acts in the clockwise direction as a result of the inherent weight of the portal assembly 31 which carries the electrode lift devices urges the portal assembly with the lower part of its frame 37 against the vessel substructure 14. In the pressure contact region, the vessel substructure 14 is provided with a support extension 38 against which the frame 37 of the portal assembly 31 bears with a support projection 39. The support extension 38 and the support projection 39 are of such dimensions as to provide for perpendicular orientation of the bar electrodes 28 in the furnace vessel 11.

In contrast to the above-described 'furnace vessel position' shown in FIG. 1, the portal assembly 31 is in a 'pivotal position' when it is supported with the support collar 32 of its frame 37 against a lifting/pivoting mechanism 40 and is lifted away from and therefore uncoupled from the furnace vessel 11 and the vessel substructure 14. In the 'pivotal position', the U-shaped support collar 32 lies with a support surface 41 of its base portion 42 which connects the support limbs 34, on a lift ram or post 43 of the lifting/pivoting mechanism 40. Although not shown herein, the support surface 41 has a recess into which a pin on the lift post 43 engages so that the support collar 32 is prevented from slipping off the lifting/pivoting mechanism 40. As a result of the portal assembly 31 being supported on one side on the lifting/pivoting mechanism 40 and as a result of the inherent weight of the portal assembly, the arrangement involves a support moment which is directed in the counter-clockwise direction so that the lower part of the frame 37 of the portal assembly 31 is urged against the lifting/pivoting mechanism 40. Similarly to the vessel substructure 14, the lift post 43 of the lifting/pivoting mechanism 40 has a support extension 44 against which a support projection 45 of the portal assembly 31 comes to bear so that the bar electrodes are oriented substantially perpendicularly in the 'pivotal position' of the portal assembly 31.

Starting from the 'furnace vessel position' shown in FIG. 1, the portal assembly 31 is moved into the 'pivotal position' by the lift post 43 of the lifting/pivoting mechanism 40 being lifted, when the bar electrodes 28 have been moved upwardly by the electrode lift devices 30, so that the head of the lift post 43 bears against the support surface 41 and, upon further upward movement of the lift post 43, the connection between the support limbs 34 of the support collar 32 and the support holder 33 on the vessel substructure 14 is disengaged. When the connection is made between the head of the lift post 43 and the support surface 41, a connection is also made between the support extension 44 of the lift post 43 and the support projection 45 on the portal assembly 31. The contact surfaces between the support extension 38 and the support projection 39 on the one hand, and between the support extension 44 and the support projection 45 on the other hand, converge downwardly. That ensures reliable engagement and release of the contact surfaces in the upward and downward movement of the portal assembly 31.

FIG. 3 shows a view of the melting furnace 10 which has been turned in the counter-clockwise direction through 90° relative to FIG. 1 so that the tilting movement now takes place in the plane of the drawing. FIG. 3 shows three different positions of the furnace 10. In the position identified at I, the furnace 10 is in its position in which it is tilted furthest towards the left and in which the furnace 10 is inclined relative to the vertical through an angle of −8°. The vertical position of the furnace 10 is shown at II. Finally, III shows the tapping position for the furnace 10, in which the furnace 10 is tilted towards the right through about +15° relative to the vertical, in order to permit the molten material to flow out of the tap hole of the furnace vessel 11 into the ladle 26 which is disposed therebeneath.

FIG. 3 shows the displacement of a connecting cross-section 46 which is also shown in FIG. 1, in the connecting region 22 between the furnace gas discharge 21 and the disposal conduit system 23, upon tilting movement of the furnace vessel 11.

As a comparison between positions I, II and III shows, with the selected position of the connecting region 22, that is to say when the middle of the connecting cross-section 46 is arranged approximately on the tilting axis 36, the transverse displacements which occur can be accommodated by the sliding coupling sleeve 47 diagrammatically shown in FIG. 1 as they are relatively slight.

FIG. 2 shows a smelting unit according to the invention having two melting furnaces 10/1 and 10/2 with which the portal assembly 31 that carries the electrode lift devices 30 can be alternately associated. The reference numerals correspond to those used in FIG. 1, with the addition after the oblique slash of the digit 1 to identify the first furnace and the digit 2 to identify the second furnace.

The furnaces 10/1 and 10/2 are arranged in side-by-side mirror-image relationship. The disposal conduit system 23 is connected to the furnaces 10/1 and 10/2 in the manner shown in FIG. 1. The region of the disposal conduit system 23 illustrated in FIG. 2 comprises a central conduit 48 from which furnace conduits 49 and 50 extend for connection to the furnace gas discharges 21/1 and 21/2. Sliding connecting sleeves 47/1 and 47/2 are provided in the connecting regions 22/1 and 22/2 to provide the connections between the furnace conduits 49 and 50 and the furnace gas discharges 21/1 and 21/2. In addition the furnaces 10/1 and 10/2 are connected directly to each other by a cover conduit 51. The cover conduit 51 comprises two conduit portions 52/1 and 52/2 which each communicate by one end with the furnace cover 12/1 and 12/2 respectively and which are connected by their other end to a central conduit portion 53, to form a continuous manifold conduit. The central conduit portion 53 is provided with connecting sleeves at its two ends for connection to the conduit portions 52/1 and 52/2. In addition the central conduit portion 53, like the two furnace conduits 49 and 50, is provided with respective shut-off members 55, 54/1 and 54/2. Operation of the smelting unit shown in FIG. 2 is described hereinafter.

For the purposes of charging the furnace 10/1, the portal assembly 32, with the electrode support arms 29 raised, is raised and pivoted away laterally by means of the lifting/pivoting mechanism 40. Thereafter the holding structure 17/1 is moved on rails (not shown here) which are connected to the vessel substructure 14/1 towards the side, that is to say from the position shown in FIG. 2 towards the left, in which case the upper portion 24 of the furnace gas discharge 21/1 is separated from its lower portion 25 (see FIG. 1) in the region of the connecting sleeve 56 so that the furnace vessel 11/1 is then free for the charging operation. After charge material has been charged directly into the furnace vessel 11/1, the vessel cover 12/1 with the shaft 16/1 is moved into the operating position again so that the vessel cover 12/1 is again closed to the furnace vessel 11/1. Prior to the movement of the vessel cover 12/1, it is raised slightly by way of a lift device (not shown here) with the holding structure 17/1 and is lowered again after the return movement on to the furnace vessel 11/1.

Then, when the shaft cover 20/1 has been moved to the side, further charge material is introduced into the shaft 16/1 until it is completely filled. The volume of the charge material corresponds to that of an entire molten bath. The shut-off members 54/1, 54/2, 55 of the gas conduit system are controlled in such a way that the waste gases from the furnace 10/1 are passed by way of the furnace conduit 49 to the central conduit 48.

After the bar electrodes 28 have been moved into the operating position for the furnace 10/1 by the lifting/pivoting mechanism 40 and the electrode lift devices 30 and the arcs have been fired, the smelting process is initiated in that furnace. Besides the bar electrodes 28, it is also possible to provide additional burners as a heating means.

While the first phase of the smelting procedure is taking place in the furnace 10/1 and the furnace gases which are produced in that situation are passed by way of the shaft 16/1 through the gas discharge 21/1 to a dust removal device connected to the central conduit 48, the second furnace vessel 11/2 can be charged in the same manner as the first furnace vessel 11/1 was previously charged. As long as the waste gases in the first furnace 10/1 are adequately cooled by the charge material in the shaft 16/1, they are passed directly to the dust removal device. If the temperatures of the waste gases from the shaft 16/1 have reached a sufficiently high value and the second furnace 10/1 is already charged and the cover has been moved back on to the furnace vessel 11/2 from the position shown in FIG. 2, then the waste gas is diverted through the cover conduit 51 into the furnace vessel 11/2 of the second furnace 10/2 and passed through the shaft 16/2 of that furnace and the furnace gas discharge 21/2 into the furnace conduit 50 to the central conduit 48. For that purpose the shut-off member 54/1 is closed and the shut-off members 55 and 54/2 are opened.

When the molten bath in the first furnace 10/1 is ready for tapping, the bar electrodes 28 and the portal assembly 32 are raised and pivot immediately to the second furnace 10/2 in order there directly to begin with the smelting procedure after the shut-off members 54/1, 54/2, 55 have been switched over, similarly to the procedure described above in relation to the furnace 10/1. The first furnace 10/1 can now be moved into the tapping position, and tapped off, by tilting movement of the furnace rocking cradle 13/1, as a consequence of actuation of the control member 35 (see FIG. 3). Prior to the tilting movement of the furnace 10/1, the sleeve connection between the conduit portion 52/1 of the cover conduit 51 and the central conduit portion 53 is released in order to be able to tilt the furnace 10/1 unimpededly.

In order to carry out the operation of removing slag from the molten bath, which takes place during the smelting procedure and in which the furnace 10/1 or 10/2 is tilted through about −3° in the direction of the position identified by I in FIG. 3, there is no need for separation of the conduit portion 52/1 or 52/2 respectively from the central conduit portion 53 as the relative movement which occurs between the conduit portions as a result of the tilting movement of the furnace 10/1 or 10/2 is compensated for by the sliding coupling sleeves between the conduit portions.

We claim:

1. A smelting unit comprising a furnace vessel (11), said furnace vessel being mounted on a furnace rocking cradle (13), and a cover (12) for closing said furnace vessel, said cover having an electrode passage opening, and at least one bar electrode (28) which can be lowered into the furnace vessel (11) through said electrode passage opening in said cover (12); an electrode support arm (29) for gripping said at least one bar electrode; at least one electrode lift device (30) which can raise and lift said electrode support arm (29); a portal assembly (31) for carrying said at least one electrode lift device (30), said portal assembly (31) in a lowered position being releasably connected to the furnace vessel (11) and being tiltable together therewith; a lift post (43) of a stationary lifting/pivoting mechanism (40) for pivotting said portal assembly to a side; said furnace vessel in a lowered position being uncoupled from the portal assembly (31), wherein in a lowered position the portal assembly (31) lies on a support holder (33) of a vessel substructure (14) or the furnace rocking cradle (13) respectively.

2. A smelting unit as set forth in claim 1 wherein the portal assembly (31) has a support collar (32) which on the furnace side lies on the support holder (33) at a spacing relative to a perpendicular line through the centre of gravity of the portal assembly (31) and which on the opposite side has a support surface (41) for the lift post (43).

3. A smelting unit as set forth in claim 1 or claim 2 wherein a frame (37) of the portal assembly (31), in the lower region, has a support projection (39) at the furnace side, which in the lowered position of the portal assembly (31) is supported against a support extension

(38) on the vessel substructure (14), and on the opposite side has a further support projection (45) which in a raised position of the portal assembly is supported against a support extension (44) on the lift post (43).

4. A smelting unit as set forth in claim 3 wherein said support projections (39) and (45) has contact surfaces which converge downwardly.

5. A smelting unit comprising a tiltable melting furnace (10) provided with a furnace gas discharge (21) which is connected in a connecting region (22) to a disposal conduit system (23) which extends away and which is stationarily installed in the area around the furnace (10), as set forth in claim 1 further comprising a connecting cross-section (46) having a middle in which is disposed substantially on the tilting axis (36) formed by the support contact line between the furnace rocking cradle (13) and its rolling motion plane.

6. A smelting unit as set forth in claim 1 wherein arranged beside the furnace (10/1) in mirror-image relationship is a second furnace (10/2) of the sane structure and a common portal assembly (31) can be moved selectively by means of the lifting/pivoting mechanism (40) to bear on a support holder (33/1) of the first furnace (10/1) and a support holder (33/2) of the second furnace.

7. A smelting unit having first and second tiltable melting furnaces (10/1, 10/2), each of which is provided with a furnace gas discharge (21/1, 21/2) connected to a disposal conduit system (48, 49, 50), a heating means (28) arranged on a portal assembly (31) for heating and melting charge material which is charged into the first and second furnaces (10/1 and 10/2), and first and second vessel covers (12/1, 12/2) for the first and second furnaces (10/1, 10/2), comprising each vessel cover (12/1, 12/2) is arranged together with a shaft (16/1 and 16/2 respectively) in a holding structure (17/1 and 17/2 respectively, each shaft (16/1, 16/2) is provided in its upper region with a loading opening (18) and a furnace gas discharge (21/1, 21/2) which is connected to the disposal conduit system (48, 49, 50), and the two vessel covers (12/1, 12/2) are connected together by a cover conduit (51) for the furnace waste gases.

8. A smelting unit as set forth in claim 7 wherein the cover conduit (51) has two conduit portions (52/1, 52/2) which are each connected by their one end to a respective vessel cover (12/1 and 12/2) and which are connected at their other end by a central conduit portion (53).

9. A smelting unit as set forth in claim 8 wherein the central conduit portion (53) is connected at both ends to the conduit portions (52/1, 52/2) by means of connecting sleeves.

10. A smelting unit as set forth in claim 6 further comprising shut-off members (54/1, 54/2, 55) for controlling the flow of gas between the two melting furnaces (10/1, 10/2) and from the two melting furnaces to the disposal conduit system (48, 49, 50).

11. A method of melting charge material in a smelting unit wherein said smelting unit includes a furnace vessel (11), said furnace vessel being mounted on a furnace rocking cradle (13), and a cover (12) for closing said furnace vessel, said cover having an electrode passage opening, and at least one bar electrode (28) which can be lowered into the furnace vessel (11) through said electrode passage opening in said cover (12); an electrode support arm (29) for gripping said at least one bar electrode; at least one electrode lift device (30) which can raise and lift said electrode support arm (29); a portal assembly (31) for carrying said at least one electrode lift device (30), said portal assembly (31) in a lowered position being releasably connected to the furnace vessel (11) and being tiltable together therewith; a lift post (43) of a stationary lifting/pivoting mechanism (40) for pivoting said portal assembly to a side; said furnace vessel in a lowered position being uncoupled from the portal assembly (31), wherein in a lowered position the portal assembly (31) lies on a support holder (33) of a vessel substructure (14) or the furnace rocking cradle (13) respectively, said method comprising the following method steps:

charging charge material into the first melting furnace (10/1);

controlling shut-off members (54/1, 54/2, 55) in such a way that the waste gases of the first furnace (10/1) are passed by way of the shaft (16/1) thereof to the disposal conduit system (48, 49, 50), said shut-off members (54/1, 54/2, 55) being provided for controlling the flow of gas between the two melting furnaces (10/1, 10/2) and from them to the disposal conduit system (348, 49, 50);

heating the charge material in the first furnace (10/1) by the heating means (28) and discharging the waste gases through the shaft of said furnace (10/1);

charging charge material into a second furnace (10/2), said second furnace arranged beside the furnace (10/1) in mirror-image relationship and said second furnace (10/2) being of the same structure and a common portal assembly (31) can be moved selectively by means of the lifting/pivoting mechanism (40) to bear on a support bolder (33/1) of the first furnace (10/1) and a support holder (33/2) of the second furnace;

controlling the shut-off members (54/1, 54/2, 55) in such a way that the waste gases are passed from the first furnace (10/1) through the cover conduit (51) into the second furnace (10/2) and by way of the shaft (16/2) thereof and a furnace conduit (50) of the second furnace (10/2) to the central conduit (48) of the disposal conduit system (48, 49, 50);

when the molten bath in the first furnace (10/1) is ready for tapping, controlling the shut-off members (54/1, 54/2, 55) in such a way that the waste gases of the second furnace (10/2) are passed by way of the shaft (16/2) thereof and the furnace conduit (50) thereof to the central conduit (58) of the disposal conduit system (48, 49, 50);

heating the charge material in the second furnace (10/2) by the heating means (28) and discharging the waste gases through the shaft of said furnace (10/2); and tapping the molten bath in the first furnace (10/1).

12. A method of melting charge material as set forth in claim 11 wherein prior to the step of charging the first furnace (10/1) the portal assembly (32) carrying the heating means (28) is raised by means of a lifting/pivoting mechanism (40) and pivoted away laterally, and that the first cover (12/1) is pivoted to the side by means of its holding structure (17) and thus clears the first furnace (10/1) for the filling operation, and that after the step of charging the first furnace (10/1) the holding structure (17) is moved back into the operating position in which the first cover (12/1) covers the first furnace (10/1).

13. A method of melting charge material as set forth in claim 12 wherein the first furnace (10/1) is further filled by way of its shaft (16/1).

* * * * *